United States Patent [19]

Genini

[11] 4,076,053

[45] Feb. 28, 1978

[54] MEANS GUIDING THE STRAPS OF THE WEFT CARRYING GRIPPERS INSIDE THE SHED

[75] Inventor: Graziano Genini, Stabio, Switzerland

[73] Assignee: Albatex A.G., Vaduz, Liechtenstein

[21] Appl. No.: 704,630

[22] Filed: Jul. 12, 1976

[51] Int. Cl.[2] ..... D03D 47/18

[52] U.S. Cl. ..... 139/449

[58] Field of Search ..... 139/188, 190, 441, 444, 139/445, 446, 449

[56] References Cited

U.S. PATENT DOCUMENTS

| | | | |
|---|---|---|---|
| 1,664,014 | 3/1928 | Austin | 139/449 |
| 1,983,409 | 12/1934 | Shimwell | 139/188 |
| 2,248,641 | 7/1941 | Moessinger | 139/188 |
| 3,299,911 | 1/1967 | Dewas | 139/449 |
| 3,717,182 | 2/1973 | Sparling | 139/446 |
| 3,842,869 | 10/1974 | Champagne | 139/188 |
| 3,957,089 | 5/1976 | Martinelli | 139/449 |

*Primary Examiner*—Henry S. Jaudon
*Attorney, Agent, or Firm*—Young & Thompson

[57] ABSTRACT

In a weaving loom without shuttles, the weft carrying grippers freely bear on the lower lap of the warp yarns and are guided, at least laterally, by a plurality of very simple and light guides, emerging from the sley and/or from the reed.

9 Claims, 5 Drawing Figures

MEANS GUIDING THE STRAPS OF THE WEFT CARRYING GRIPPERS INSIDE THE SHED

BACKGROUND OF THE INVENTION

The present invention relates to an improved system for guiding the weft carrying members inside the shed, in weaving looms without shuttles and with movable reed. More particularly, the invention relates to a system for guiding a pair of weft threads carrying grippers, whose to-and-fro movements between the loom ends and the centre of the shed (where they exchange weft) are produced by flexible straps carrying at their end the grippers themselves.

As known to the experts in the field, among the solutions so far adopted for the weft insertion between the warp yarns in the so-called continuous weft feed looms, the most adopted solution has been that consisting in the use of grippers replacing the more traditional shuttles and whose movement through the warp shed may be obtained either by means of stiff rods or by means of flexible straps. The use of stiff rods has the drawback of undesirable bulkiness in the loom, while the use of flexible straps (with which the problem of bulk is avoided by winding the strap, at the sides of the loom, around curved surfaces) causes inconveniences of some importance when the loom speed exceeds certain limits, as is apt to happen in the most modern of these machines. In this case, in fact, especially with looms for weaving in great heights, the straps wear phenomena become worrying and a certain instability in the trajectories of the straps and of the grippers carried thereby may take place, whereby the grippers — having abandoned their ideal trajectory — may easily meet at the centre of the shed, for weft exchange, in a mutual position which is not convenient or even unsuited for correctly carrying out said exchange.

The essential problem of looms without shuttles, with weft feeding grippers guided by straps, is hence at present — in connection with the mentioned drawbacks — to carry out a correct guiding of such straps (and consequently of the grippers carried thereby) or of the grippers themselves.

The solutions adopted so far for this problem are not in fact satisfactory: on one hand, there have been used guides acting on both sides of the strap (or of the base of the grippers) and engaging, as well as the side, also a portion of the upper and lower faces of the strap, and on the other hand, use has been made — more recently — of the free running of the grippers and of the strap on the lower lap of the warp yarns.

In the first case, the drawbacks are of known type: the guides are of complicated and bulky shape and hence costly and heavy; moreover, they are numerous and thus rather close one to the other. Because of their dimensions and number, many of the warp yarns end by being subjected to frequent and heavy as well as prejudicial rubbing, while because of their shape, because of the width of the contacting surfaces and because of their number, remarkable heating by friction is produced on the straps. Moreover, with these guides, the movement of the strap and/or of the gripper takes place at a small distance from the lower lap of the warp, the yarns of which may easily get caught and dragged by the strap or by the gripper within the guides, where they can get pinched and cut, in the event of certain causes — which may frequently occur — such as strap burrs, knots in the threads, loose threads, too much slack — due to wear — between straps and guides, and the like. All such drawbacks — which frequently result in breaks in the warp yarns and too much wear of the straps (or of the guided parts of the grippers) — become all the more serious, the higher the running speed of the loom, and when said speed reaches the top limits being aimed at nowadays, said drawbacks even exclude the use of this guiding system.

An attempt has been made — just to avoid the drawbacks of the aforespecified system — to use the system of free running of the grippers and of the straps inside the shed, bearing at the bottom on the lower lap of the warp yarns and with lateral guide bearing on the reed. Said system has proved quite successful for certain speed ranges of the loom, which were not so long ago considered high, but with the further increase of the speeds, it no longer sufficiently guarantees that the grippers will meet in the correct position for weft exchange. Said system is moreover unsuited for being applied in looms of the so-called type with movable reed.

SUMMARY OF THE INVENTION

The aforespecified drawbacks are now eliminated in a fully satisfactory way by the present invention, which solves the problem of a rational and efficient guiding of the weft carrying grippers straps in shuttleless looms, through an improved system which is particularly adapted to be used in looms of the type with movable reed — also of large dimensions, for the production of very wide fabrics — towards which type are now tending the techniques relating to high speed and high productivity weaving machines.

Such a system is substantially characterized by the fact that the weft carrying grippers straps and/or the grippers themselves are freely bearing on the lower lap of the warp yarns and are guided, at least laterally, by a plurality of very simple and light guides and/or by the reed.

Preferably, said guides are hook-shaped, being formed by an upperly square bent shank and adapted to therefore guide the straps on the upper side as well as laterally, by engaging a portion of their upper face as well as the side, while the lower face remains free and freely bearing on the lower lap of the warp.

It is possible to provide a double row of hooked guides, one on one side and one on the opposite side of the straps, or else a single row of hooked guides on the side of the straps opposite to the reed: in this last case, the straps and/or the grippers are freely guided by the reed itself on their side close to this member of the loom.

It is also possible to provide guides formed by simple pins, in which case the guiding of the straps and/or grippers takes place only sideways and the straps themselves freely bear, with their lower face, on the lower lap of the warp, while their upper face is completely free. Also with this arrangement, it is possible to use two rows of guides, one for each side of the straps or grippers, or else a single row of pin guides on the side of the strap far from the reed, leaving this last member to freely guide the other side of the straps close thereto.

In each case, the guides have their shank ending below with a cylindrical threaded part, which extends through one of the holes provided for the purpose in an angle bar fixed to the sley or onto a bracket extension of the sley itself, for receiving a locking nut: the mounting of the guides and their structure prove hence to be very simple and easy.

BRIEF DESCRIPTION OF THE DRAWINGS

The invention will now be described in further detail, by referring to the accompanying drawings, which show a preferred embodiment thereof and in which.

DESCRIPTION OF THE PREFERRED EMBODIMENTS

Figure 1:
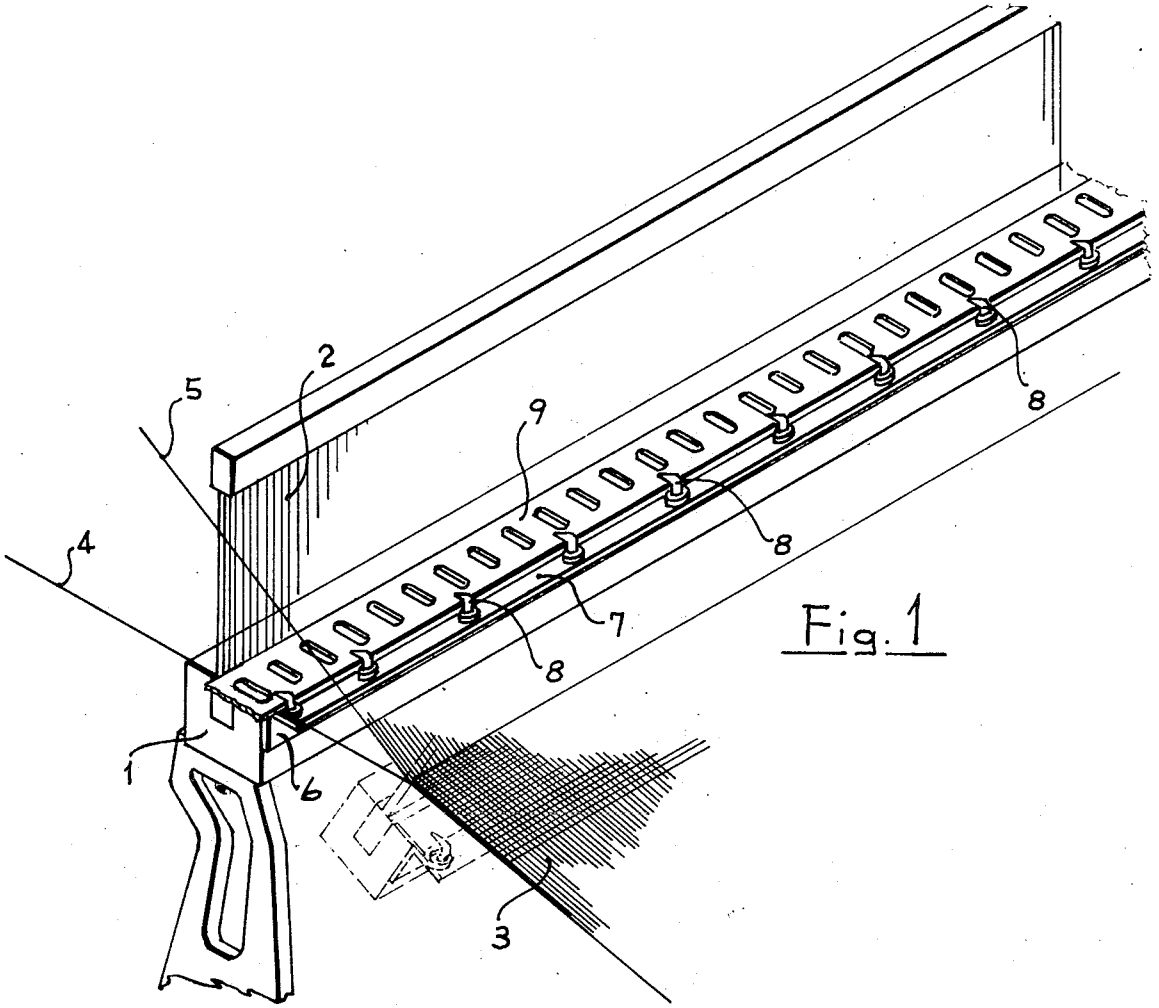
FIG. 1 is an axonometric view of a loom part comprising the guides according to the invention, which illustrates in dashed lines the position of the sley at the moment in which it causes the reed to tighten the weft thread inserted on the already formed fabric.

With reference to the drawings, FIG. 1 shows the sley 1 on which is mounted the reed 2 and, moreover, the already formed fabric 3 and the two laps 4 and 5 of the warp, forming the shed.

On the side towards the fabric, the sley 1 carries mounted thereon an angle bar 6, or it extends into a bracket 6', the surface 6'' of which is at the same level as the upper surface of the sley 1. Reference 7 indicates a track on which bears the lower lap 4 of the warp, said track being applied on said surface 6'' and being preferably made of low friction plastic material, for example with phenolic lining. On the angle bar 6 or on the bracket 6' are mounted the guides 8 of the straps 9 according to the invention; said guides comprise a shank 10, which ends at the bottom with a threaded cylindrical part 11, inserting itself into an appropriate hole of the angle bar 6 or of the bracket 6', for fixing thereto thanks to the shoulder 11', embedded in the track 7, and to the nut 12.

Figure 4:
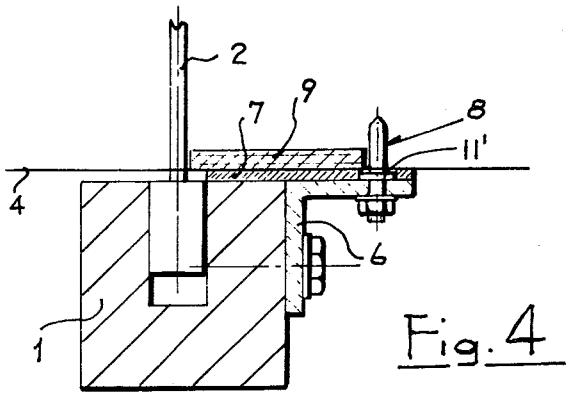
FIGS. 4 and 5 are sections similar to that of FIG. 2, wherein the system of the invention uses pin guides, arranged respectively in a single row and in a double row.
Figure 5:
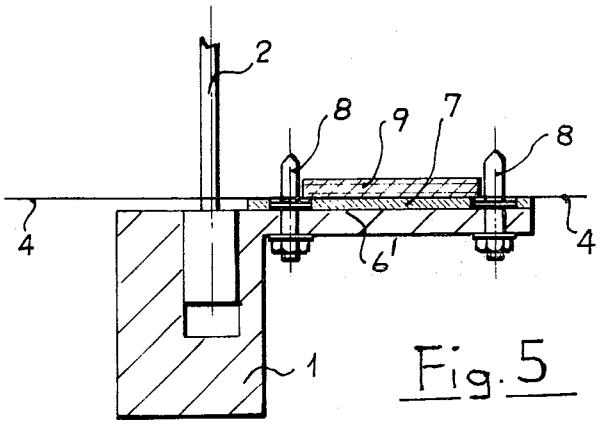
Figure 2:
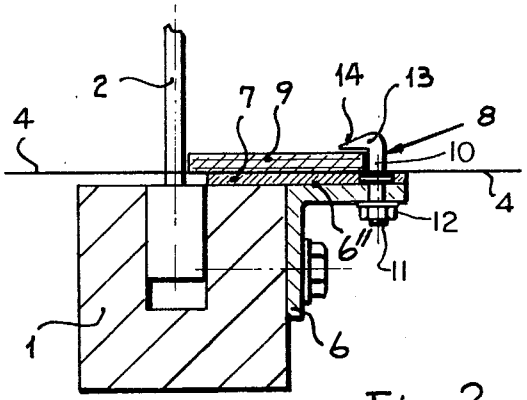
FIG. 2 is a cross-sectional view of the loom of FIG. 1, showing in detail a first embodiment of the guiding system for the gripper carrying straps according to the invention, comprising (according to FIG. 1) a single row of hook guides.
Figure 3:
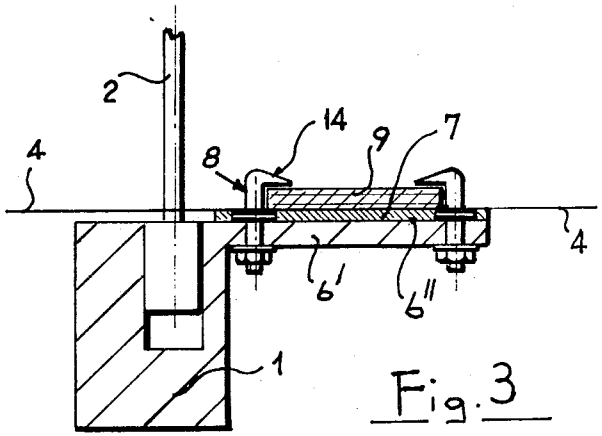
FIG. 3 is a section similar to that of FIG. 2, but showing an embodiment of the system according to the invention comprising two rows of hook guides.

The guides 8 may be hook-shaped — as in the case of the embodiments of the invention according to FIGS. 1, 2 and 3 — or they may simply be formed by pins — as in the case of FIGS. 4 and 5.

In FIGS. 1 and 2, a single row of hook guides 8 is provided. In this embodiment, the strap (or the gripper) is guided on its side facing the fabric by a plurality of hook guides 8 — which need not be numerous, in the devices tested so far with excellent results — being held laterally by the shank 10 and, on the upper side, by the bent element 13 of the guides themselves. The strap then freely bears with its lower surface on the lower lap 4 of the warp yarns, above the low friction track 7, and is also freely guided laterally by the reed 2, on the side opposite to that being held by the guides 8 and adjacent to the reed itself.

FIG. 3 shows a variant of the solution of FIGS. 1 and 2. In said figure are provided two parallel rows of hook guides 8, the first row being in the same position as that of the arrangement according to FIG. 2, and the second row being close to the reed 2. The strap 9 — freely bearing with its lower face on the lower lap 4 of the warp, which is in turn arranged on the track 7 — is guided on its opposite sides by the shanks 10, and on portions of its upper face adjacent to said sides by the bent elements 13 of the hook guides.

FIG. 4 shows a solution similar to that of FIGS. 1 and 2, save for the fact that the guides 8 are simple pins; the strap or grippers are in this case guided only laterally, as well as bearing on the lower lap of the warp, but they are instead free at the top.

Finally, the solution of FIG. 5 provides the use — as in FIG. 3 — of two rows of guides 8, which are however — as in FIG. 4 — pin guides. Also in this case, the strap 9 is guided only on the sides and it is free at the top, while bearing with the lower face on the lower lap 4 of the warp.

Many advantages derive from applying the system according to the invention. First of all — as can easily be seen — the guides 8 are simple and light and their mounting and replacement require no special operations or setting: it is in fact sufficient to screw and/or unscrew the nuts 12 in respect of the threaded part of the shank 10 of the guides, which hence do not require — as was the case for all the guides of the prior art — either any particular supports, or any special restraints, for their mounting on the sley. All this helps to greatly limit the mass in reciprocating motion of the unit comprising the sley, the sliding track of the gripper carrying straps and the guides for said straps, with the consequence of limiting also the dynamic stresses due to inertial effects and of reducing the widths and the intensity of the vibratory phenomena. Moreover, the aforedescribed guides are of very small width, which allows them to move down below the fabric during beating up of the reed — as shown on the right side of FIG. 1, where the sley is illustrated in dashed lines — even with a limited travel of the sley on which they are mounted. This is particularly advantageous in the case of weaving looms working at high speeds and it allows to construct the machine in a far more economical way than had been possible up to the present.

It is then of fundamental importance to note that, with the system according to the invention, the gripper carrying straps and/or the grippers travel freely bearing on the lower lap of the warp, and this makes it impossible for them to force the warp yarns to be pinched and hence cut by the guides, as used to happen with the known type guides. Moreover, the guides according to the invention — due to their shape, their reduced size, their low height and their limited number — produce a rubbing stress on the warp yarns which is far lower, in intensity and number of threads involved, than that of the guides of known looms. For all these reasons, the warp yarns are far less frequently broken, than in the case of prior art, even if the loom speed increases, with the advantages which need not be underlined.

Although the above described embodiments of the invention are deemed to be the most convenient ones, at least at present, it is evident that other embodiments of the invention may be possible, still falling within the scope of the invention itself: in particular, the modifications may concern the shapes and arrangement of the guides, or the mounting thereof on the sley. For example, the sley may also be provided in the form of a complex metal section, from which the guides are obtained by milling of vertical brackets, projecting from the upper plane of the sley itself. The invention can equally well be applied — as has been said — both in the case of guiding the grippers or elements thereof and in the case of guiding the straps: in the former case, the grippers may comprise inserted parts for bearing and guiding on the reed, when adopting the solutions of FIGS. 2 or 4.

I claim:

1. In a system for guiding inside the warp yarns shed the straps of weft carrying grippers in shuttleless weaving looms comprising a sley and a reed, of the type in which said grippers are moved backward and forward into the shed between upper and lower laps of the warp yarns by a pair of flexible straps arranged in a substantially horizontal plane parallel to the sley; the improvement in which said straps freely bear on the lower lap of the warp yarns and are guided along at least one side edge by a plurality of guides upstanding from the sley, said guides being separate from each other and individually secured to the sley and extending through the sley, and means bearing against the underside of the sley for releasably securing said guides to the sley.

2. A system as claimed in claim 1, said guides each comprising a pin that extends downwardly through the sley and is individually secured to the sley.

3. A system as claimed in claim 2, said pins being straight vertical pins.

4. A system as claimed in claim 2, said pins having bent over upper ends that extend horizontally toward the reed above the straps.

5. A system as claimed in claim 1, there being a row of said guides along each edge of said strap.

6. In a system for guiding inside the warp yarns shed the straps of weft carrying grippers in shuttleless weaving looms comprising a sley and a reed, of the type in which said grippers are moved backward and forward into the shed between upper and lower laps of the warp yarns by a pair of flexible straps arranged in a substantially horizontal plane parallel to the sley; the improvement in which said straps freely bear on the lower lap of the warp yarns and are guided along at least one side edge by a plurality of guides upstanding from the sley, said sley having a horizontal flange thereon that extends away from said reed, said guides extending through said horizontal flange and being separately secured on the underside of said flange by releasable fasteners.

7. In a system for guiding inside the warp yarns shed the straps of weft carrying grippers in shuttleless weaving looms comprising a sley and a reed, of the type in which said grippers are moved backward and forward into the shed between upper and lower laps of the warp yarns by a pair of flexible straps arranged in a substantially horizontally plane parallel to the sley; the improvement in which said straps freely bear on the lower lap of the warp yarns and are guided along at least one side edge by a plurality of guides upstanding from the sley, said guides extending through the sley and terminating downwardly in screw-threaded lower ends to which nuts are applied against the underside of the sley thereby releasably to secure the guides to the sley.

8. In a system for guiding inside the warp yarns shed the straps of weft carrying grippers in shuttleless weaving looms comprising a sley and a reed, of the type in which said grippers are moved backward and forward into the shed between upper and lower laps of the warp yarns by a pair of flexible straps arranged in a substantially horizontal plane parallel to the sley; the improvement in which said straps freely bear on the lower lap of the warp yarns and are guided along at least one side edge by a plurality of guides upstanding from the sley, said guides each comprising a pin that extends downwardly through the sley and is individually secured to the sley, said pins having shoulders thereon that bear against the upper side of the sley.

9. A system as claimed in claim 8, said shoulders being embedded in a track of low friction plastic material whose upper side is contacted by said lower warp yarns.

* * * * *

UNITED STATES PATENT AND TRADEMARK OFFICE

CERTIFICATE OF CORRECTION

PATENT NO. : 4,076,053

DATED : February 28, 1978

INVENTOR(S) : Graziano GENINI

It is certified that error appears in the above-identified patent and that said Letters Patent are hereby corrected as shown below:

In the Heading of the patent, insert the following:

--[30] Foreign Application Priority Data

July 10, 1975 Switzerland..... 9000/75--

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*